United States Patent [19]

Hampton

[11] Patent Number: 5,003,697

[45] Date of Patent: Apr. 2, 1991

[54] TELESCOPIC SIGHT LENS PROTECTOR

[75] Inventor: William B. Hampton, 3659 Glennie Rd., Glennie, Mich. 48737

[73] Assignees: William B. Hampton; Jeanne M. Hampton, Glennie. Mich.

[21] Appl. No.: 445,465

[22] Filed: Dec. 4, 1989

[51] Int. Cl.[5] ..... F41G 1/04; F41G 11/00

[52] U.S. Cl. ..... 33/244; 350/587

[58] Field of Search ..... 33/244; 350/587, 582

[56] References Cited

U.S. PATENT DOCUMENTS

| | | | |
|---|---|---|---|
| 1,710,109 | 4/1929 | Paulus et al. | 33/244 |
| 2,514,257 | 7/1950 | Reavis | 33/244 |
| 2,534,061 | 12/1950 | Rogers | 350/587 |
| 2,632,252 | 3/1953 | Blais, Sr. . | |
| 2,738,585 | 3/1956 | Vissing | 33/244 |
| 2,782,510 | 2/1957 | Kramm | 33/244 |
| 2,849,795 | 9/1958 | Vissing | 33/244 |
| 3,131,477 | 5/1964 | Thomas . | |
| 3,208,146 | 9/1965 | Nelson | 33/244 |
| 3,426,433 | 2/1969 | Anderson | 350/587 |
| 3,465,446 | 9/1969 | Cox | 33/244 |
| 3,496,642 | 2/1970 | Pfahler | 33/244 |
| 3,746,423 | 7/1973 | Mills | 33/244 |

FOREIGN PATENT DOCUMENTS 0193614 3/1907 Fed. Rep. of Germany ..... 250/587

*Primary Examiner*—Thomas B. Will

*Attorney, Agent, or Firm*—Michael L. Bauchan

[57] ABSTRACT

A Telescopic Sight Lens Protector is provided which includes first and second lens cover assemblies for covering opposite ends of a telescopic sight and an operating assembly attached to the telescopic sight for selectively moving the lens cover assemblies axially and rotatably about the operating assembly axis. The operating assembly includes a pinion gear having an axis at right angles to the operating assembly axis and two racks resiliently biased on the operating assembly axis toward the pinion gear so as to hold the lens cover assemblies against the opposite ends of the telescopic sight. Moving one lens cover assembly axially simultaneously moves the other lens cover assembly axially in the opposite direction. Rotating either lens cover assembly about the operating assembly axis simultaneously rotates the other lens cover assembly about the operating assembly axis the same angle and direction.

11 Claims, 2 Drawing Sheets

TELESCOPIC SIGHT LENS PROTECTOR

SUMMARY OF THE INVENTION

A Telescopic Sight Lens Protector is provided which provides a means of covering both ends of a telescopic sight with a transparent lens at each sight end.

The lens protector includes a lens cover assembly which holds a transparent lens on the sight axis for viewing through both the transparent lenses and the sight for protecting the sight from rain and other elements. The transparent lenses are rigidly held in position with a water tight seal on the telescopic sight.

The lens cover assemblies are held against the telescopic sight by a lens cover operating system which includes a central pinion gear and two racks which are resiliently biased toward the pinion gear so as to hold the lens cover assemblies against the telescopic sight ends so as to enable the user to simultaneously move the lens cover assemblies axially in opposite directions and simultaneously rotate the lens cover assemblies in the same angular direction so as to simultaneously uncover both ends of the telescopic sight by grasping and moving the lens cover proximate either end of the telescopic sight.

BACKGROUND OF THE INVENTION

Telescopic sights are in common usage. The subject lens protector is suitable for use on many telescopic sights, including those which are commonly identified as a telescope and those telescopic sights which are special purpose telescopes specifically manufactured for purposes of attachment to a rifle or other firearm or weapon.

Rain and other elements moisten, fog and otherwise interfere with viewing through telescopic sights, particularly those which are used on rifles for hunting purposes. It is important to be able to clearly view a target through a telescopic sight at the critical moment when a rifle is being aimed to fire.

Rifles and the telescopic sights attached to them are also subject to neglect and abuse during hunting, including the dropping of the rifle and the pushing aside of snow covered branches using the rifle, all of which can obscure the view through the telescopic sight.

Often the hunter must respond very quickly to sighting game. It is important that the lens protector used on a telescopic sight securely protect the sight and yet be quickly removable from the sight so as to immediately provide a clear view of a target through the sight with a minimum of difficulty and fumbling by the user.

Various telescopic sight lens protectors have previously been invented. Blais U.S. Pat. No. 2,632,252 and Paulus et al. U.S. Pat. No. 1,710,109 are U.S. patents which have lens protector devices which rotate one or more lens covers about an axis which is parallel to the telescopic sight axis.

Rogers U.S. Pat. No. 2,534,061, Mills U.S. Pat. No. 3,746,423 and Reavis U.S. Pat. No. 2,514,257 are U.S. patents which describe various telescopic sight protectors in which the lens covers pivot about an axis which is substantially at right angles to the telescopic sight axis.

Anderson U.S. Pat. No. 3,426,433, Thomas U.S. Pat. No. 3,131,477 and Nelson U.S. Pat. No. 3,208,146 are U.S. patents which describe various other telescopic sight lens protectors which cover and uncover the ends of a telescopic sight in various other ways.

None of these prior art telescopic sight lens protectors incorporate in a single apparatus the full measure of protection for the telescopic sight which is essential together with ability to use the telescopic sight when the lens protector is clean without removing the lens protector and the ability to quickly remove a lens cover from both ends of a telescopic sight with a single secure movement to place both lens covers in a predetermined rotated angular position away from the face of the user, all of which are objects of the present invention which are accomplished only through the present invention.

DESCRIPTION OF THE PREFERRED EMBODIMENT

Figure 1:
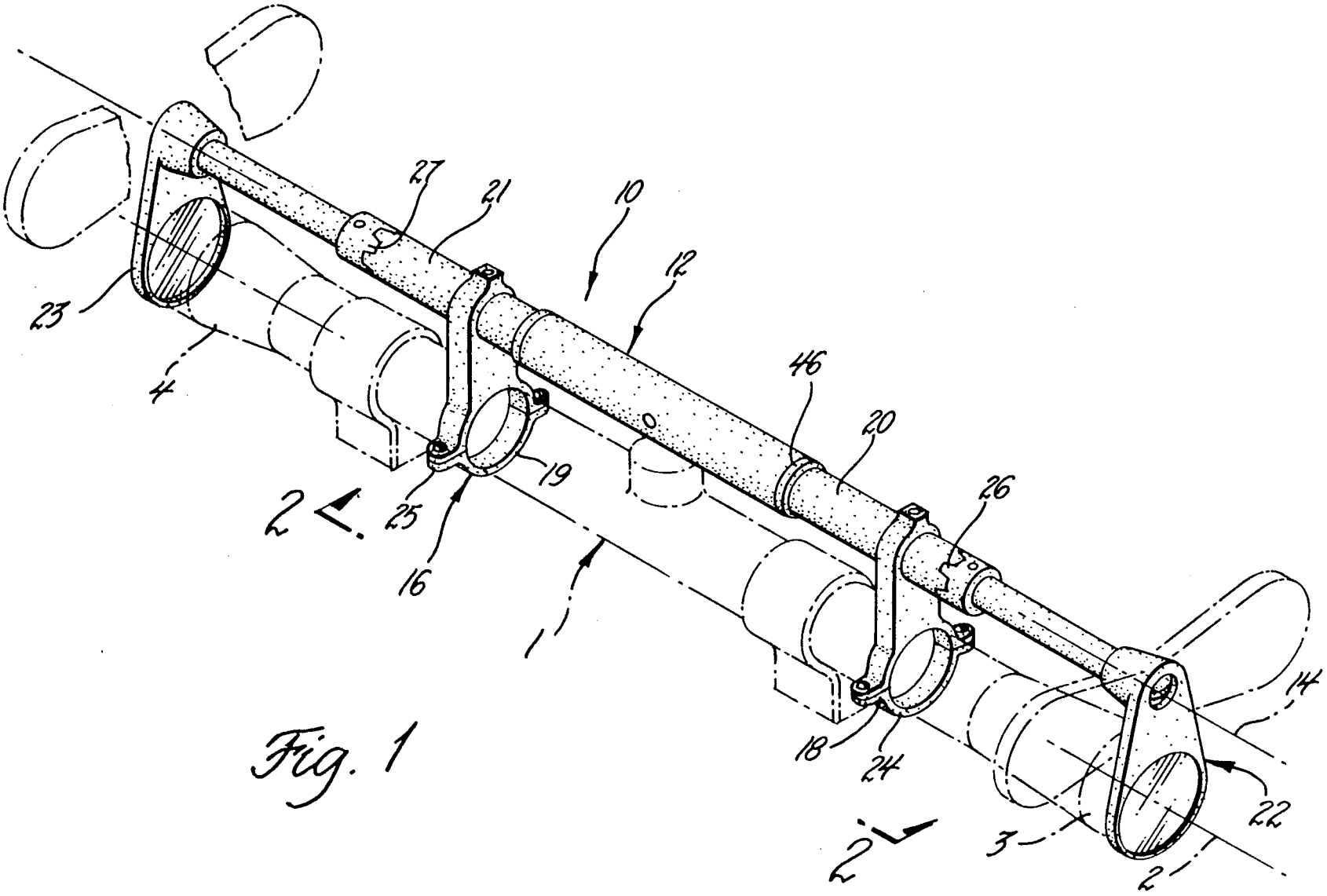
FIG. 1 is a perspective view of a lens protector embodying the principles of the subject invention.

As shown in FIG. 1, a conventional telescopic sight 1 is indicated in dashed lines with a lens protector 10 which embodies the spirit of the subject invention.

As shown in FIG. 1, the telescopic sight 1 is defined by a sight axis 2.

As shown in FIG. 1, the lens protector 10 includes a lens cover operating assembly 12 defined by an operating assembly axis 14 which is substantially parallel to the sight axis 2. The sight includes first and second ends 3 and 4. The first and second ends 3 and 4 of the telescopic sight 1 each contain various glass elements of conventional type well known to persons versed in the art. Lens protector 10 also includes an attachment assembly 16 for attaching the lens cover operating assembly 12 to the sight 1. The attachment assembly 16 includes first and second attachment brackets 18 and 19 to which are secured attachment tubes 20 and 21 defined by the operating assembly axis 14.

The lens protector 10 also includes first and second lens cover assemblies 22 and 23 for selectively covering and uncovering the first and second ends 3 and 4 of telescopic sight 1.

As shown in FIG. 1, first and second cover assemblies 22 and 23 selectively pivot on the operating assembly axis 14 so as to be selectively rotatable to predetermined positions which are at a predetermined angular rotation about operating assembly axis 14 as shown in phantom lines in FIG. 1.

Attachment brackets 18 and 19 include split rings 24 and 25 which may be bolted together in a manner familiar to persons versed in the art to secure attachment brackets 18 and 19 to the telescopic sight 1. Attachment tubes 20 and 21 in the preferred embodiment have serrated edges 26 and 27 into which the first and seconds lens cover assemblies 22 and 23 are fitted so they can be held in predetermined angular positions relative to operating assembly axis 14 as shown in dashed lines in FIG. 1 as will subsequently be described.

Figure 2:
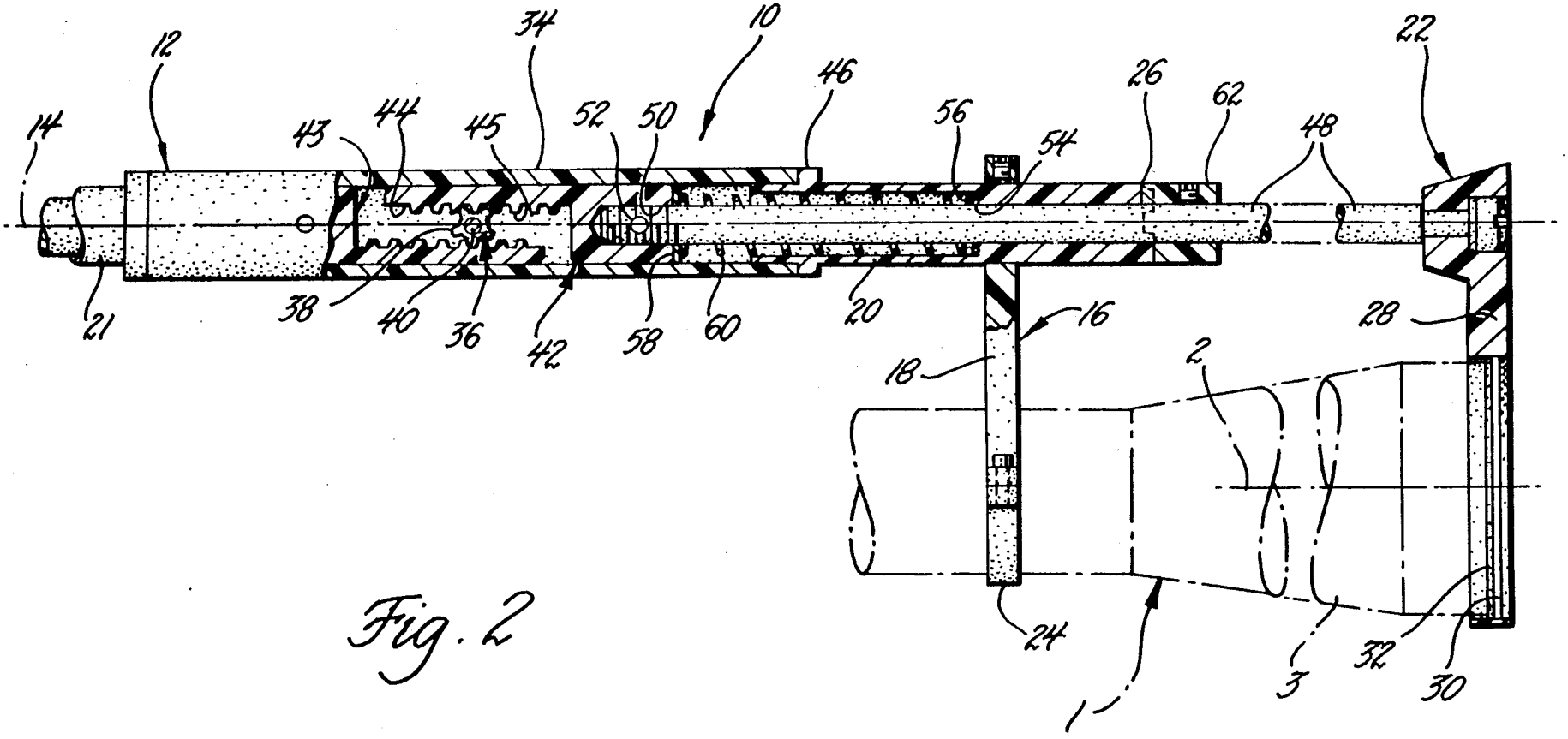
FIG. 2 is a partial sectional view of the lens protector in FIG. 1 on line 2—2.

As shown in FIG. 2 which is a partial cross-section view taken along lines 2—2 in FIG. 1, the first lens cover assembly, which is similar in construction to the second lens cover assembly, includes a lens frame 28, a transparent lens 30 which in the preferred embodiment is a clear circular disk of plastic, and an annular gasket 32 adapted to receive a first end 3 of telescopic sight 1 so as to form a water proof seal which prevents the elements from getting on the lens of telescopic sight 1.

As shown in FIG. 2, the lens cover operating assembly in the illustrated embodiment includes a cylindrical sleeve 34 defined by the operating assembly axis 14. Inside the lens cover operating assembly 12 is a rotation and linear motion imparting pinion assembly 36 which includes a pinion gear 38 mounted on a pin 40 secured to sleeve 34 on a pinion axis which is at right angles to the operating assembly axis 14.

The lens cover operating assembly 12 also includes first and second lens cover actuator assemblies 42 and 43 which are identical in configuration so only the first lens cover actuator 42 is shown in detail in FIG. 2.

As shown in FIG. 2, first lens cover actuator assembly 42 includes a first rack 44 having a toothed surface 45 which engages pinion gear 38 and which is defined by the operating assembly axis 14. The rack 44 slides axially on operating assembly axis 14 within sleeve 34, which has an inside diameter slightly larger than the outside diameter of first attachment tube 20 which in turn is fitted with a radial flange 46 so that sleeve 34 is free to rotate on attachment tube 20 which is rigidly secured by attachment bracket 18 to the telescopic sight 1. Sleeve 34 is restrained axially by flange 46 and its counter part on second attachment tube 21.

As shown in FIG. 2, the first lens cover actuator assembly 42 also includes a lens cover support rod 48 to which is attached lens frame 28 in a conventional manner.

A recess 50 is formed in rack 44 into which lens cover support rod 48 is placed and secured by a pin 52 to rack 44. An annular interior shoulder 54 is formed in attachment tube 20 with a washer 56 adjacent shoulder 54. A second washer 58 is placed around lens cover support rod 48 adjacent rack 44 and a compressive spring 60 is placed around lens cover support rod 48 between washers 56 and 58 so as to bias rack 44 axially to the left on operating assembly axis 14 toward pinion gear 38, which biases pinion gear 38 counter clockwise as shown in FIG. 2. A serrated cylindrical ring 62 is secured to lens cover support rod 48 with serrations which match serrated edge 26 of tube 20.

Spring 20 therefore resiliently biases first lens cover assembly axially to the left on operating assembly axis 14 as shown in FIG. 2 and serrated edge 26 provides various fixed detentes for selectively fixing the angular position of the first lens cover assembly 22 about operating assembly axis 14. As shown in FIG. 2, the usual position of first lens cover assembly 22 is with the annular gasket 32 receiving first end 3 of telescopic sight 1 as that a hunter may look through transparent lens 30 and telescopic sight 1 and a corresponding transparent lens in second lens cover assembly 23. The lens cover assemblies 22 and 23 thus are usually in the position shown in solid lines in FIG. 1 to protect telescopic sight 1.

When the lens cover assemblies 22 and 23 are to be removed from ends 3 and 4 of telescopic sight 1 this is accomplished by grasping one of the lens cover assemblies 22 and 23 and pulling it axially on operating assembly axis 14 and then rotating it a predetermined angle around operating assembly axis 14 either to the right or to the left as shown in dashed lines in FIG. 1.

For example, if first lens cover assembly 22 in FIG. 2 is pulled to the right against the spring 60 biased force the first lens cover assembly 22 is pulled off first end 3 of telescopic sight 1. Then first lens cover assembly 22 is rotated about operating assembly axis 14. As lens cover support rod 48 is rotated rack 44 is also rotated, causing pinion gear 38 and sleeve 34 to be rotated about operating assembly axis 14 while flange 46 on tube 20 guides this rotational action.

It should be noted that axial movement of first lens cover assembly 22 in FIG. 2 to the right rotates pinion gear 38 clockwise in FIG. 2 so as to simultaneously drive the rack of the second lens cover actuator assembly 43 to the left. It is thus apparent that axial movement of either lens cover assembly in a first direction on operating assembly axis 14 drives the other lens cover actuator assembly in the opposite direction on operating assembly axis 14. It is also apparent that both of the lens cover actuator assemblies 42 and 43 rotate together with sleeve 34 so both lens cover assemblies 22 and 23 rotate in the same direction to the same angular position around operating assembly axis 14.

It is thus apparent that when first lens cover assembly 22 is released after being rotated about operating assembly axis 14 the serrated edge 26 is engaged and the lens cover assemblies 22 and 23 are held in a preselected position as shown in dashed lines in FIG. 1. A quick axial pull of first lens cover assembly 22 and rotation in the opposite direction covers up first end 3 of telescopic sight 1 so as to protect telescopic sight 1.

It is thus apparent that I have provided a lens protector which with a single hand movement covers and uncovers both ends of a telescopic sight with a single axial pull and rotation and the lens protector is held out of the way it is until used to recover the telescopic sight 1.

Persons versed in the art will appreciate that various modifications of structure and material may be used for the lens protector 10 and various structural modifications may also be made without departing from the spirit of the invention. In the preferred embodiment the lens protector is mostly made of plastic with conventional metal fasteners. The plastic is opaque except for the transparent lens 30, which may be made of various colored polycarbonate clear plastics for vision enhancement. Lens 30 can be interchanged with such colors as clear and yellow, depending on daylight conditions, and when it is cleaned it need not be removed before using the telescopic sight 1 to fire.

I claim:

1. A lens protector for a telescopic sight having first and second ends defined by an axis comprising, in combination, a lens cover operating assembly defined by an operating assembly axis substantially parallel to said sight axis; attachment means for fixedly attaching said lens cover operating assembly to said sight so that said lens cover operating assembly is rotatable about said operating assembly axis; a first lens cover assembly fixedly secured to a first end of said lens cover operating assembly for selectively covering said first sight end; and a second lens cover assembly fixedly secured to a second end of said lens cover operating assembly for selectively covering said second sight end, rotation of said lens cover operating assembly about said operating assembly axis selectively moving said lens cover assemblies from closed to open positions relative to said sight ends; said lens cover operating assembly including a rotation and linear motion imparting pinion assembly fixedly positioned on said operating assembly axis, a first lens cover actuator assembly fixedly secured to said first lens cover assembly and axially movable on said operating assembly axis, a second lens cover actuator assembly fixedly secured to said second lens cover assembly and axially moveable on said operating assembly axis, and connection means connecting said first and second lens cover actuator assemblies to said pinion assembly for opposite axial movement on said operating assembly axis and for combined rotational movement about said operating assembly axis whereby selectively moving either of said lens cover assemblies in a first axial direction on said operating assembly axis selectively moves the other of said lens cover assemblies in a second axial direction on said operating assembly axis opposite said first axial direction and selectively rotating either of said lens cover assemblies a predetermined angle about said operating assembly axis selectively rotates the other of said lens cover assemblies said predetermined angle in the same direction about said operating assembly axis so as to simultaneously cover and uncover said sight ends and simultaneously rotate said lens cover assemblies in the same angular direction.

2. A lens protector for a telescopic sight having first and second ends defined by an axis comprising, in combination, a lens cover operating assembly defined by an operating assembly axis substantially parallel to said sight axis; attachment means for fixedly attaching said lens cover operating assembly to said sight so that said lens cover operating assembly is rotatable about said operating assembly axis; a first lens cover assembly fixedly secured to a first end of said lens cover operating assembly for selectively covering said first sight end; and a second lens cover assembly fixedly secured to a second end of said lens cover operating assembly for selectively covering said second sight end, rotation of said lens cover operating assembly about said operating assembly axis selectively moving said lens cover assemblies from closed to open positions relative to said sight ends; said lens cover operating assembly including a rotation and linear motion imparting pinion assembly fixedly positioned on said operating assembly axis, said pinion assembly including a pinion gear having a pinion axis substantially at right angles to said operating assembly axis, a first lens cover actuator assembly fixedly secured to said first lens cover assembly and axially movable on said operating assembly axis, a second lens cover actuator assembly fixedly secured to said second lens cover assembly and axially moveable on said operating assembly axis, said first and second lens cover actuator assemblies each including a rack engageable by said pinion gear and axially moveable parallel to said operating assembly axis, said racks being positioned on opposite sides of said pinion so as to effect axial movement of said racks in opposite directions on said operating assembly axis when said pinion gear rotates on said pinion axis, and connection means connecting said first and second lens cover actuator assemblies to said pinion assembly for opposite axial movement on said operating assembly axis and for combined rotational movement about said operating assembly axis whereby selectively moving either of said lens cover assemblies in a first axial direction on said operating assembly axis selectively moves the other of said lens cover assemblies in a second axial direction on said operating assembly axis opposite said first axial direction and selectively rotating either of said lens cover assemblies a predetermined angle about said operating assembly axis selectively rotates the other of said lens cover assemblies said predetermined angle in the same direction about said operating assembly axis so as to simultaneously cover and uncover said sight ends and simultaneously rotate said lens cover assemblies in the same angular direction.

3. A lens protector for a telescopic sight having first and second ends defined by an axis comprising, in combination, a lens cover operating assembly defined by an operating assembly axis substantially parallel to said sight axis; attachment means for fixedly attaching said lens cover operating assembly to said sight so that said lens cover operating assembly is rotatable about said operating assembly axis; a first lens cover assembly fixedly secured to a first end of said lens cover operating assembly for selectively covering said first sight end; and a second lens cover assembly fixedly secured to a second end of said lens cover operating assembly for selectively covering said second sight end, rotation of said lens cover operating assembly about said operating assembly axis selectively moving said lens cover assemblies from closed to open positions relative to said sight ends; said lens cover operating assembly including a rotation and linear motion imparting pinion assembly fixedly positioned on said operating assembly axis, a first lens cover actuator assembly fixedly secured to said first lens cover assembly and axially movable on said operating assembly axis, a second lens cover actuator assembly fixedly secured to said second lens cover assembly and axially moveable on said operating assembly axis, at least one detent connecting at least one of said lens cover actuator assemblies to said attachment means for selectively retaining at least one of said lens cover assemblies in at least two predetermined angular positions relative to said operating assembly axis, and connection means connecting said first and second lens cover actuator assemblies to said pinion assembly for opposite axial movement on said operating assembly axis and for combined rotational movement about said operating assembly axis whereby selectively moving either of said lens cover assemblies in a first axial direction on said operating assembly axis selectively moves the other of said lens cover assemblies in a second axial direction on said operating assembly axis opposite said first axial direction and selectively rotating either of said lens cover assemblies a predetermined angle about said operating assembly axis selectively rotates the other of said lens cover assemblies said predetermined angle in the same direction about said operating assembly axis so as to simultaneously cover and uncover said sight ends and simultaneously rotate said lens cover assemblies in the same angular direction.

4. A lens protector for a telescopic sight having first and second ends defined by an axis comprising, in combination, a lens cover operating assembly defined by an operating assembly axis substantially parallel to said sight axis; attachment means for fixedly attaching said lens cover operating assembly to said sight so that said lens cover operating assembly is rotatable about said operating assembly axis; a first lens cover assembly fixedly secured to a first end of said lens cover operating assembly for selectively covering said first sight end; and a second lens cover assembly fixedly secured to a second end of said lens cover operating assembly for selectively covering said second sight end, rotation of said lens cover operating assembly about said operating assembly axis selectively moving said lens cover assemblies from closed to open positions relative to said sight ends; said lens cover operating assembly including a pinion assembly fixedly positioned on said operating assembly axis, said pinion assembly including a pinion gear having a pinion axis substantially at right angles to said operating assembly axis, a first lens cover actuator assembly fixedly secured to said first lens cover assembly and axially movable on said operating assembly axis, a second lens cover actuator assembly fixedly secured to said second lens cover assembly and axially moveable on said operating assembly axis, said first and second lens cover actuator assemblies each including a rack engageable by said pinion gear and axially moveable parallel to said operating assembly axis, said racks being positioned on opposite sides of said pinion so as to effect axial movement of said racks in opposite directions on said operating assembly axis when said pinion gear rotates on said pinion axis, at least one detent connecting at least one of said lens cover actuator assemblies to said attachment means for selectively retaining at least one of said lens cover assemblies in at least two predetermined angular positions relative to said operating assembly axis, and connection means connecting said first and second lens cover actuator assemblies to said pinion assembly for opposite axial movement on said operating assembly axis and for combined rotational movement about said operating assembly axis whereby selectively moving either of said lens cover assemblies in a first axial direction on said operating assembly axis selectively moves the other of said lens cover assemblies in a second axial direction on said operating assembly axis opposite said first axial direction and selectively rotating either of said lens cover assemblies a predetermined angle about said operating assembly axis selectively rotates the other of said lens cover assemblies said predetermined angle in the same direction about said operating assembly axis so as to simultaneously cover and uncover said sight ends and simultaneously rotate said lens cover assemblies in the same angular direction.

5. A lens protector for a telescopic sight having first and second ends defined by an axis comprising, in combination, a lens cover operating assembly defined by an operating assembly axis substantially parallel to said sight axis; attachment means for fixedly attaching said lens cover operating assembly to said sight so that said lens cover operating assembly is rotatable about said operating assembly axis; a first lens cover assembly fixedly secured to a first end of said lens cover operating assembly for selectively covering said first sight end; and a second lens cover assembly fixedly secured to a second end of said lens cover operating assembly for selectively covering said second sight end, rotation of said lens cover operating assembly about said operating assembly axis selectively moving said lens cover assemblies from closed to open positions relative to said sight ends; said lens cover operating assembly including a pinion assembly fixedly positioned on said operating assembly axis, said pinion assembly including a pinion gear having a pinion axis substantially at right angles to said operating assembly axis, a first lens cover actuator assembly fixedly secured to said first lens cover assembly and axially movable on said operating assembly axis, a second lens cover actuator assembly fixedly secured to said second lens cover assembly and axially moveable on said operating assembly axis, said first and second lens cover actuator assemblies each including a rack engageable by said pinion gear and axially moveable parallel to said operating assembly axis, said racks being positioned on opposite sides of said pinion so as to effect axial movement of said racks in opposite directions on said operating assembly axis when said pinion gear rotates on said pinion axis, at least one bias means for biasing said first and second lens cover actuator assemblies axially on said operating assembly axis toward said pinion gear, at least one detent connecting at least one of said lens cover actuator assemblies to said attachment means for selectively retaining at least one of said lens cover assemblies in at least two predetermined angular positions relative to said operating assembly axis, and connection means connecting said first and second lens cover actuator assemblies to said pinion assembly for opposite axial movement on said operating assembly axis and for combined rotational movement about said operating assembly axis whereby selectively moving either of said lens cover assemblies in a first axial direction on said operating assembly axis selectively moves the other of said lens cover assemblies in a second axial direction on said operating assembly axis opposite said first axial direction and selectively rotating either of said lens cover assemblies a predetermined angle about said operating assembly axis selectively rotates the other of said lens cover assemblies said predetermined angle in the same direction about said operating assembly axis so as to simultaneously cover and uncover said sight ends and simultaneously rotate said lens cover assemblies in the same angular direction.

6. A lens protector for a telescopic sight having first and second ends defined by an axis comprising, in combination, a lens cover operating assembly defined by an operating assembly axis substantially parallel to said sight axis; attachment means for fixedly attaching said lens cover operating assembly to said sight so that said lens cover operating assembly is rotatable about said operating assembly axis; a first lens cover assembly fixedly secured to a first end of said lens cover operating assembly for selectively covering said first sight end; and a second lens cover assembly fixedly secured to a second end of said lens cover operating assembly for selectively covering said second sight end, rotation of said lens cover operating assembly about said operating assembly axis selectively moving said lens cover assemblies from closed to open positions relative to said sight ends, said first and second lens cover assemblies each including a transparent lens and a lens frame for selectively positioning said transparent lens on said sight axis so as to permit simultaneous viewing through said telescopic sight and both of said transparent lenses; said lens cover operating assembly including a rotation and linear motion imparting pinion assembly fixedly positioned on said operating assembly axis, a first lens cover actuator assembly fixedly secured to said first lens cover assembly and axially movable on said operating assembly axis, a second lens cover actuator assembly fixedly secured to said second lens cover assembly and axially moveable on said operating assembly axis, and connection means connecting said first and second lens cover actuator assemblies to said pinion assembly for opposite axial movement on said operating assembly axis and for combined rotational movement about said operating assembly axis whereby selectively moving either of said lens cover assemblies in a first axial direction on said operating assembly axis selectively moves the other of said lens cover assemblies in a second axial direction on said operating assembly axis opposite said first axial direction and selectively rotating either of said lens cover assemblies a predetermined angle about said operating assembly axis selectively rotates the other of said lens cover assemblies said predetermined angle in the same direction about said operating assembly axis so as to simultaneously cover and uncover said sight ends and simultaneously rotate said lens cover assemblies in the same angular direction.

7. A lens protector for a telescopic sight having first and second ends defined by an axis comprising, in combination, a lens cover operating assembly defined by an operating assembly axis substantially parallel to said sight axis; attachment means for fixedly attaching said lens cover operating assembly to said sight so that said lens cover operating assembly is rotatable about said operating assembly axis; a first lens cover assembly fixedly secured to a first end of said lens cover operating assembly for selectively covering said first sight end; and a second lens cover assembly fixedly secured to a second end of said lens cover operating assembly for selectively covering said second sight end, rotation of said lens cover operating assembly about said operating assembly axis selectively moving said lens cover assemblies from closed to open positions relative to said sight ends, said first and second lens cover assemblies each including a transparent lens and a lens frame for selectively positioning said transparent lens on said sight axis so as to permit simultaneous viewing through said telescopic sight and both of said transparent lenses; said lens cover operating assembly including a pinion assembly fixedly positioned on said operating assembly axis, said pinion assembly including a pinion gear having a pinion axis substantially at right angles to said operating assembly axis, a first lens cover actuator assembly fixedly secured to said first lens cover assembly and axially movable on said operating assembly axis, a second lens cover actuator assembly fixedly secured to said second lens cover assembly and axially moveable on said operating assembly axis, said first and second lens cover actuator assemblies each including a rack engageable by said pinion gear and axially moveable parallel to said operating assembly axis, said racks being positioned on opposite sides of said pinion so as to effect axial movement of said racks in opposite directions on said operating assembly axis when said pinion gear rotates on said pinion axis, and connection means connecting said first and second lens cover actuator assemblies to said pinion assembly for opposite axial movement on said operating assembly axis and for combined rotational movement about said operating assembly axis whereby selectively moving either of said lens cover assemblies in a first axial direction on said operating assembly axis selectively moves the other of said lens cover assemblies in a second axial direction on said operating assembly axis opposite said first axial direction and selectively rotating either of said lens cover assemblies a predetermined angle about said operating assembly axis selectively rotates the other of said lens cover assemblies said predetermined angle in the same direction about said operating assembly axis so as to simultaneously cover and uncover said sight ends and simultaneously rotate said lens cover assemblies in the same angular direction.

8. A lens protector for a telescopic sight having first and second ends defined by an axis comprising, in combination, a lens cover operating assembly defined by an operating assembly axis substantially parallel to said sight axis; attachment means for fixedly attaching said lens cover operating assembly to said sight so that said lens cover operating assembly is rotatable about said operating assembly axis; a first lens cover assembly fixedly secured to a first end of said lens cover operating assembly for selectively covering said first sight end; and a second lens cover assembly fixedly secured to a second end of said lens cover operating assembly for selectively covering said second sight end, rotation of said lens cover operating assembly about said operating assembly axis selectively moving said lens cover assemblies from closed to open positions relative to said sight ends, said first and second lens cover assemblies each including a transparent lens and a lens frame for selectively positioning said transparent lens on said sight axis so as to permit simultaneous viewing through said telescopic sight and both of said transparent lenses; said lens cover operating assembly including a rotation and linear motion imparting pinion assembly fixedly positioned on said operating assembly axis, a first lens cover actuator assembly fixedly secured to said first lens cover assembly and axially movable on said operating assembly axis, a second lens cover actuator assembly fixedly secured to said second lens cover assembly and axially moveable on said operating assembly axis, at least one detent connecting at least one of said lens cover actuator assemblies to said attachment means for selectively retaining at least one of said lens cover assemblies in at least two predetermined angular positions relative to said operating assembly axis, and connection means connecting said first and second lens cover actuator assemblies to said pinion assembly for opposite axial movement on said operating assembly axis and for combined rotational movement about said operating assembly axis whereby selectively moving either of said lens cover assemblies in a first axial direction on said operating assembly axis selectively moves the other of said lens cover assemblies in a second axial direction on said operating assembly axis opposite said first axial direction and selectively rotating either of said lens cover assemblies a predetermined angle about said operating assembly axis selectively rotates the other of said lens cover assemblies said predetermined angle in the same direction about said operating assembly axis so as to simultaneously cover and uncover said sight ends and simultaneously rotate said lens cover assemblies in the same angular direction.

9. A lens protector for a telescopic sight having first and second ends defined by an axis comprising, in combination, a lens cover operating assembly defined by an operating assembly axis substantially parallel to said sight axis; attachment means for fixedly attaching said lens cover operating assembly to said sight so that said lens cover operating assembly is rotatable about said operating assembly axis; a first lens cover assembly fixedly secured to a first end of said lens cover operating assembly for selectively covering said first sight end; and a second lens cover assembly fixedly secured to a second end of said lens cover operating assembly for selectively covering said second sight end, rotation of said lens cover operating assembly about said operating assembly axis selectively moving said lens cover assemblies from closed to open positions relative to said sight ends, said first and second lens cover assemblies each including a transparent lens and a lens frame for selectively positioning said transparent lens on said sight axis so as to permit simultaneous viewing through said telescopic sight and both of said transparent lenses; said lens cover operating assembly including a pinion assembly fixedly positioned on said operating assembly axis, said pinion assembly including a pinion gear having a pinion axis substantially at right angles to said operating assembly axis, a first lens cover actuator assembly fixedly secured to said first lens cover assembly and axially movable on said operating assembly axis, a second lens cover actuator assembly fixedly secured to said second lens cover assembly and axially moveable on said operating assembly axis, said first and second lens cover actuator assemblies each including a rack engageable by said pinion gear and axially moveable parallel to said operating assembly axis, said racks being positioned on opposite sides of said pinion so as to effect axial movement of said racks in opposite directions on said operating assembly axis when said pinion gear rotates on said pinion axis, at least one bias means for biasing said first and second lens cover actuator assemblies axially on said operating assembly axis toward said pinion gear, at least one detent connecting at least one of said lens cover actuator assemblies to said attachment means for selectively retaining at least one of said lens cover assemblies in at least two predetermined angular positions relative to said operating assembly axis, and connection means connecting said first and second lens cover actuator assemblies to said pinion assembly for opposite axial movement on said operating assembly axis and for combined rotational movement about said operating assembly axis whereby selectively moving either of said lens cover assemblies in a first axial direction on said operating assembly axis selectively moves the other of said lens cover assemblies in a second axial direction on said operating assembly axis opposite said first axial direction and selectively rotating either of said lens cover assemblies a predetermined angle about said operating assembly axis selectively rotates the other of said lens cover assemblies said predetermined angle in the same direction about said operating assembly axis so as to simultaneously cover and uncover said sight ends and simultaneously rotate said lens cover assemblies in the same angular direction.

10. A lens protector for a telescopic sight having first and second ends defined by an axis comprising, in combination, a lens cover operating assembly defined by an operating assembly axis substantially parallel to said sight axis; attachment means for fixedly attaching said lens cover operating assembly to said sight so that said lens cover operating assembly is rotatable about said operating assembly axis; a first lens cover assembly fixedly secured to a first end of said lens cover operating assembly for selectively covering said first sight end; and a second lens cover assembly fixedly secured to a second end of said lens cover operating assembly for selectively covering said second sight end, rotation of said lens cover operating assembly about said operating assembly axis selectively moving said lens cover assemblies from closed to open positions relative to said sight ends, said first and second lens cover assemblies each including a transparent lens and a lens frame for selectively positioning said transparent lens on said sight axis so as to permit simultaneous viewing through said telescopic sight and both of said transparent lenses; a first gasket proximate said transparent lens in said first lens cover assembly for selectively receiving said first sight end, a second gasket proximate said transparent lens in said second lens cover assembly for selectively receiving said second sight end, said lens cover operating assembly including a pinion assembly fixedly positioned on said operating assembly axis, said pinion assembly including a pinion gear having a pinion axis substantially at right angles to said operating assembly axis, a first lens cover actuator assembly fixedly secured to said first lens cover assembly and axially movable on said operating assembly axis, a second lens cover actuator assembly fixedly secured to said second lens cover assembly and axially moveable on said operating assembly axis, said first and second lens cover actuator assemblies each including a rack engageable by said pinion gear and axially moveable parallel to said operating assembly axis, said racks being positioned on opposite sides of said pinion so as to effect axial movement of said racks in opposite directions on said operating assembly axis when said pinion gear rotates on said pinion axis, at least one bias means for biasing said first and second lens cover actuator assemblies axially on said operating assembly axis toward said pinion gear, at least one detent connecting at least one of said lens cover actuator assemblies to said attachment means for selectively retaining at least one of said lens cover assemblies in at least two predetermined angular positions relative to said operating assembly axis, and connection means connecting said first and second lens cover actuator assemblies to said pinion assembly for opposite axial movement on said operating assembly axis and for combined rotational movement about said operating assembly axis whereby selectively moving either of said lens cover assemblies in a first axial direction on said operating assembly axis selectively moves the other of said lens cover assemblies in a second axial direction on said operating assembly axis opposite said first axial direction and selectively rotating either of said lens cover assemblies a predetermined angle about said operating assembly axis selectively rotates the other of said lens cover assemblies said predetermined angle in the same direction about said operating assembly axis so as to simultaneously cover and uncover said sight ends and simultaneously rotate said lens cover assemblies in the same angular direction.

11. A lens protector for a telescopic sight having two ends comprising, in combination, two lens covers, one lens cover being proximate each telescopic sight end, lens cover support means for rotatably and axial supporting said lens covers proximate said telescopic sight ends, connection means for axially connecting said lens covers for movement in opposite axial directions and in the same rotational direction, said connection means including two racks, means connecting each of said racks to one of said lens covers, and a pinion engaging each of said racks, and bias means for biasing said connection means axially so as to bias said lens covers axially toward each other against said sight ends.

* * * * *